United States Patent [19]

Fullerton

[11] Patent Number: 4,996,901

[45] Date of Patent: Mar. 5, 1991

[54] TAPE ADVANCING AND CUTTING MECHANISM

[76] Inventor: William S. Fullerton, 2265 Phyllis Ct., St. Paul, Minn. 55119

[21] Appl. No.: 401,970

[22] Filed: Sep. 1, 1989

[51] Int. Cl.[5] ..... B26D 5/10

[52] U.S. Cl. ..... 83/436; 83/564; 83/589; 83/649

[58] Field of Search ..... 83/436, 582, 589, 648, 83/649, 203, 205, 564

[56] References Cited

U.S. PATENT DOCUMENTS

| | | | |
|---|---|---|---|
| 1,805,619 | 5/1931 | Fuller . | |
| 1,958,443 | 5/1934 | Phillips | 83/649 X |
| 2,604,166 | 7/1952 | Turner | 83/649 X |
| 2,761,503 | 9/1956 | Krueger | 83/582 X |
| 2,822,046 | 2/1958 | Krueger | 83/649 X |
| 2,862,676 | 12/1958 | Castelli | 83/649 X |
| 2,921,493 | 1/1960 | Emmert | 83/611 |
| 3,160,047 | 12/1964 | Malloy et al. | 83/208 |
| 3,470,781 | 10/1969 | Domeny | 83/436 |
| 3,563,122 | 2/1971 | DeNeui | 83/205 |
| 3,625,100 | 12/1971 | Barnard | 83/649 X |
| 3,788,371 | 1/1974 | Mason | 144/312 |
| 3,837,549 | 9/1974 | Sengewald | 255/11 |
| 3,971,279 | 7/1976 | Wright | 83/425.4 |
| 3,971,280 | 7/1976 | Inka | 83/436 |
| 4,535,664 | 8/1985 | Raymond | 83/649 X |
| 4,638,696 | 1/1987 | Urwyler | 83/649 X |
| 4,640,167 | 2/1987 | Stusack et al. | 83/649 |
| 4,890,526 | 1/1990 | Slodic | 83/648 X |

*Primary Examiner*—Hien H. Phan
*Assistant Examiner*—Eugenia A. Jones
*Attorney, Agent, or Firm*—Anthony G. Eggink

[57] ABSTRACT

A dispensing and cutting mechanism for film or the like comprising a frame structure, means for holding a supply of film, an advancing roller structure for moving film from the film supply, means to drive the advancing roller structure, and a cutting structure mounted forward the advancing roller structure to sever a length of film. The advancing roller structure further has an idler roller and a drive roller which are mounted for rotation and in an aligned configuration to the frame structure. The cutting structure is comprised of a fixed bottom cutting structure mounted to the frame structure forward and generally in line with the idler roller. A pivotable upper cutting structure is further mounted to the drive shaft and is constructed and arranged to cooperate with the fixed bottom cutting structure.

16 Claims, 4 Drawing Sheets

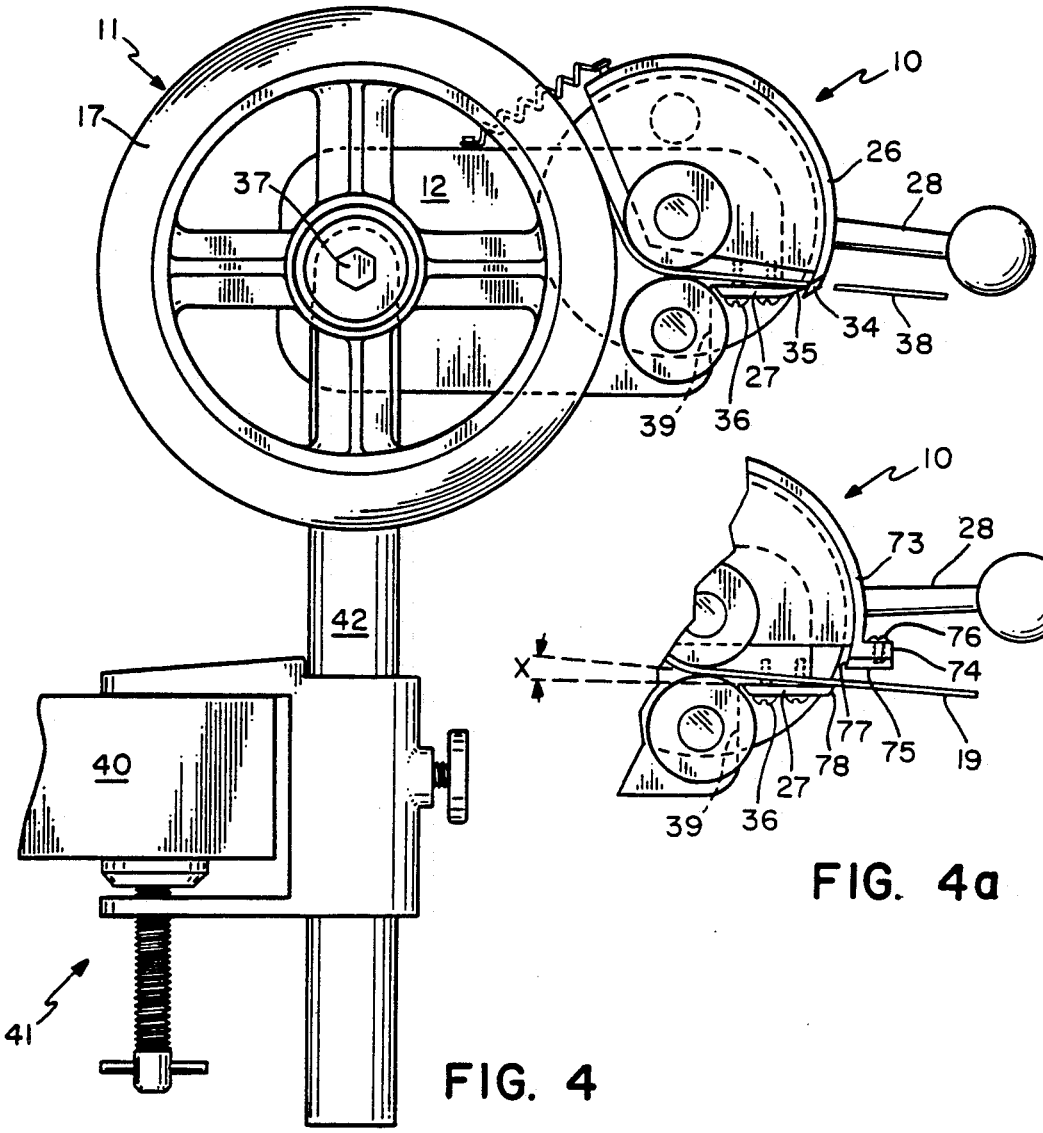
FIG. 4
FIG. 4a
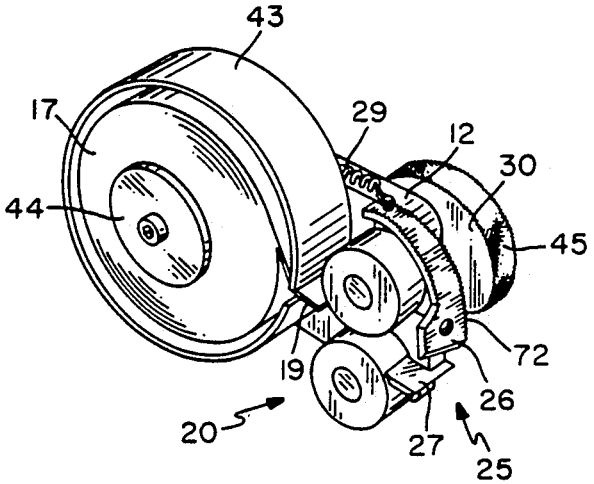
FIG. 5

TAPE ADVANCING AND CUTTING MECHANISM

BACKGROUND OF THE INVENTION

This invention relates generally to an advancing and cutting apparatus for film and paper substrates. Particularly, this invention relates to advancing and cutting mechanisms for flexible tape or film dispensed from a supply source.

In the past, various structures and devices have been proposed and utilized to advance and cut predetermined lengths of flexible strips from roll stock. However, these structures have generally been designed for specific types of roll stock and, particularly, for roll stock materials exhibiting specific physical characteristics.

For example, devices and structures have been proposed to dispense flexible cord, tape, film, paper and sheet materials. However, these devices include specific advancing wheel and roller structures as well as cutting structures to accommodate the configuration and physical properties of the materials that are dispensed and cut. Each device, therefore, is generally constructed and arranged to function under specific conditions and for specific roll stock products.

The film or tape advancing and cutting mechanism of this invention is for industrial and consumer use. And, the mechanisms are designed for automatic and hand operable purposes to feed and cut strips of film or tape from a supply source, such as roll stock.

SUMMARY OF THE INvENTION

This invention provides a dispensing and cutting mechanism for film or the like. The mechanism is comprised of a frame structure, a means for holding a supply of film, an advancing roller structure for moving film from the film supply, a means to drive the advancing roller structure, and a cutting structure mounted forward the advancing roller structure to sever a predetermined length of film.

The advancing roller structure further has an idler roller and a drive roller which are mounted to the frame structure for rotation and they are positioned in an aligned configuration. The driving means for the advancing roller structure is either manual or is accomplished automatically, such as by a motor. The cutting structure may also have a powered and activatable structure in communication therewith.

The cutting structure is comprised of a fixed bottom or anvil structure mounted to the frame structure forward and generally in line with the idler roller and a pivotable upper cutting structure mounted to the drive shaft and which is constructed and arranged to cooperate with the bottom cutting structure. The cutting structure further preferably has a top curved blade structure and a cooperating fixed curved bottom blade structure. Other upper and lower cooperating cutting structures are also provided by this invention.

These and other benefits of this invention will become clear from the following description by reference to the drawings.

BRIEF DESCRIPTION OF THE DRAWINGS

FIG. 4 is a lateral plan view of another embodiment of the film advancing and cutting mechanism;

FIG. 4*a* is a lateral plan view of the mechanism of FIG. 4 and showing an alternate embodiment of the cutting mechanism of the invention;

FIG. 5 is a perspective view of a hand held, thumb operated embodiment of the mechanism;

DESCRIPTION OF THE PREFERRED EMBODIMENTS

Figure 1:
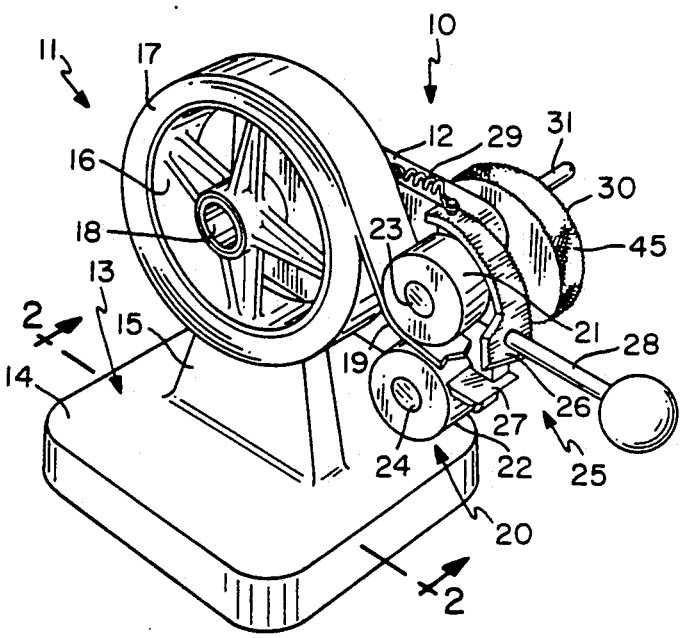
FIG. 1 is a perspective view of an embodiment of the film advancing and cutting mechanism of this invention.

Referring to FIG. 1, an embodiment 10 of the advancing and cutting mechanism of this invention is there shown mounted to a base structure 13 having a vertically extending portion 15 and a base member 14. The mechanism 10 is shown mounted to the vertical portion 15 by its frame member 12 and is removable from the base structure 13 for use separate therefrom.

The advancing and cutting mechanism 10 is further shown to have a film or tape supply structure 11 which is mounted for rotation to the frame structure 12. The film supply structure 11 has a supply roll holder 16 on which a roll of film or tape 17 is frictionally mounted, for example. The roll 17 is mounted for rotation on a mandrel or shaft 18. As the roll 17 is unwound a film or tape supply stream 19 is generated.

The advancing and cutting mechanism 10 further has an advancing structure 20 which is comprised of a drive roller 21 and an idler roller 22 which, respectively, are mounted on shafts 23 and 24. The shafts 23 and 24 are mounted to the frame structure 12, as known in the art.

A cooperating cutting structure 25 is further provided and which is comprised of a rotatable upper cutting member 26 and a lower fixed cutting member 27. As further shown, a handle or lever member 28 extends from the upper cutting member 26 for gripping by the user. A biasing spring 29 is provided to bring the upper cutting member 26 to its original upward position after use. The cutting structure 25 is positioned forward the advancing structure 20 and is mounted to the frame structure 12.

Further shown is a drive wheel 30 which is fixed to the drive roller shaft 23. A turning handle 31 extends from the drive wheel 30 for use by the operator. Thus, the rotation of the drive wheel 30 advances a portion of tape or film 19 between the drive and idler rollers 21 and 22.

Figure 2:
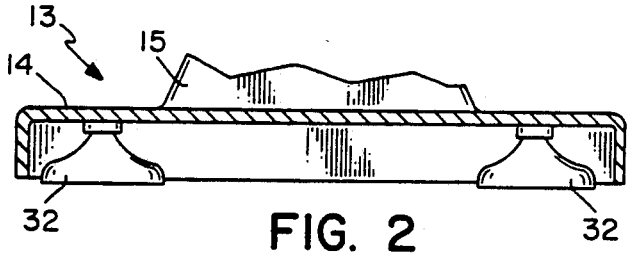
FIG. 2 is a cross sectional view of a portion of the mechanism taken along line 2—2 of FIG. 1.

As shown in FIG. 2, the base plate 14 has a number of suction cups 32 attached to the lower portion of the base plate 14 to provide means to secure the mechanism 10 to a flat surface. Other embodiments utilizing the mechanism 10 will be further discussed below.

Figure 3:
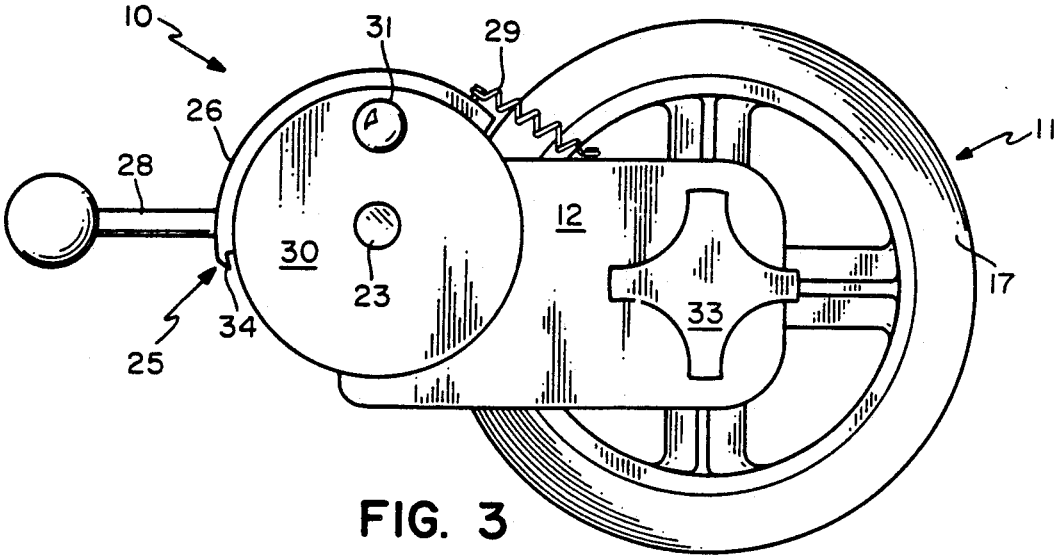
FIG. 3 is a rear view of the mechanism and shown removed from the base as shown in FIG. 1.

FIGS. 3 and 4 show lateral views of the device or mechanism 10 and which show the rotatable upper cutting member 26 to have a curved configuration. Further, the film or tape supply structure 11 is shown mounted to the frame structure 12 by means of a fastening knob 33. In FIG. 4, the rotatable upper cutting member 26 is shown to have an upper cutting edge 34 that cooperates with the lower cutting edge 35 of the bottom cutting member 27 which is fixed in a notched portion 39 of the frame structure 12 by means of fastening screws 36. Further shown is a fastening bolt 37 which permits the rotation of the tape supply structure 11 with respect to the frame structure 12 and which further holds an adjustable shaft 42 that extends downwardly from the frame structure 12 and which engages an adjustable clamping structure 41 that can be utilized for mounting to a table or work surface edge 40.

FIG. 4*a* shows an embodiment of the mechanism 10 having a rotatable upper cutting structure 73 which permits the replacement of the upper cutting blade 75 by means of a mounting extension 74 at its bottom end. The outwardly extending structure 74 is shown to have apertures for screw(s) 76 for securing the cutting blade 75. The upper cutting edge 77 and the lower cutting edge 78 of the fixed bottom cutting member 27 are preferably configured to have aligned outer cutting surfaces being shaped in cross-section as circular segments having the same radius. Thus, the aligned, cooperating and opposing cutting edges 77 and 78 travel on generally the same radial path to cause a scissor-like shear action which provides a smooth cut at a relatively low pressure force for most films and papers.

Further shown in FIG. 4*a* is the alignment of the film or tape supply stream 19 with respect to the lower cutting edge 78. It has been found that an angular path of travel, depicted by angle "x", is preferred for cutting purposes of film and paper substrates. Thus, the angle from the nip of the drive and idler rollers of the advancing structure 10 with respect to a horizontal line to the lower cutting edge 78, as shown by angle "x", is preferred to be approximately 15° for most substrates, and particularly for polymeric film substrates.

FIG. 5 shows a hand-held and thumb operated embodiment of the advancing and cutting mechanism. The mechanism is shown to have a housing structure 43 which surrounds the roll of film or tape 17 and which is held to the frame structure 12 by means of a fastening structure 44. The drive wheel 30 is further shown to have a knurled circumferential surface 45, and the rotatable upper cutting member 26 is shown to have a grooved or knurled upper surface 72 which can be engaged by the user's thumb. This embodiment permits the user to hold and activate the advancing and cutting structures by using one hand.

Thus, FIG. 5 shows a thumb operated tape advancing and cutting embodiment which has an enclosure or housing 43 with an opening or slot which also guides the tape supply 17. A shaft or mandrel and the roll holding structure 44 laterally extend from the frame 12. A roll of tape 17 having a one inch diameter core, for example, is placed onto the roll holding structure 44 and the tape feed is extended between the drive roller and the idler or contact roller as shown. The pivotable cutting structure 25 is shown to pivot about the shaft of the drive roller.

The advancing and cutting structure of FIG. 5 further shows the rotatable upper cutting member 26 to have an aperture therein for receiving the handle or lever 28, as shown in FIG. 1. Further and importantly, the cutting edge of the rotatable upper cutting member 26 is shown to have an angled configuration. In other words, the upper cutting edge is not parallel to the cutting edge of the fixed lower bottom cutting member 27. Thus, the angled cutting arrangement shown causes a scissor-like cutting action between the rotatable upper cutting member 26 and the lower cutting member 27. This angled cutting action has been found preferred in the cutting of most film substrates.

Figure 6:
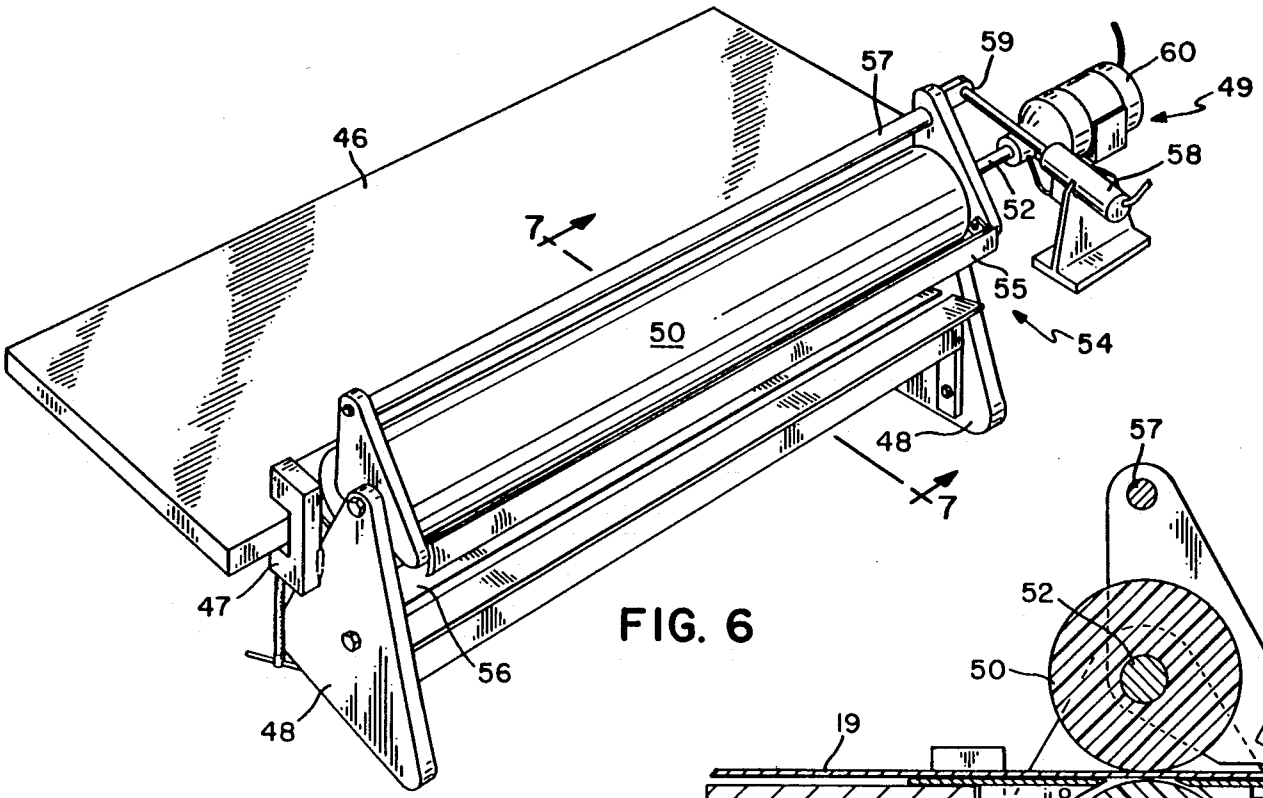
FIG. 6 is a perspective view of another embodiment of the advancing and cutting mechanism of this invention.
Figure 7:
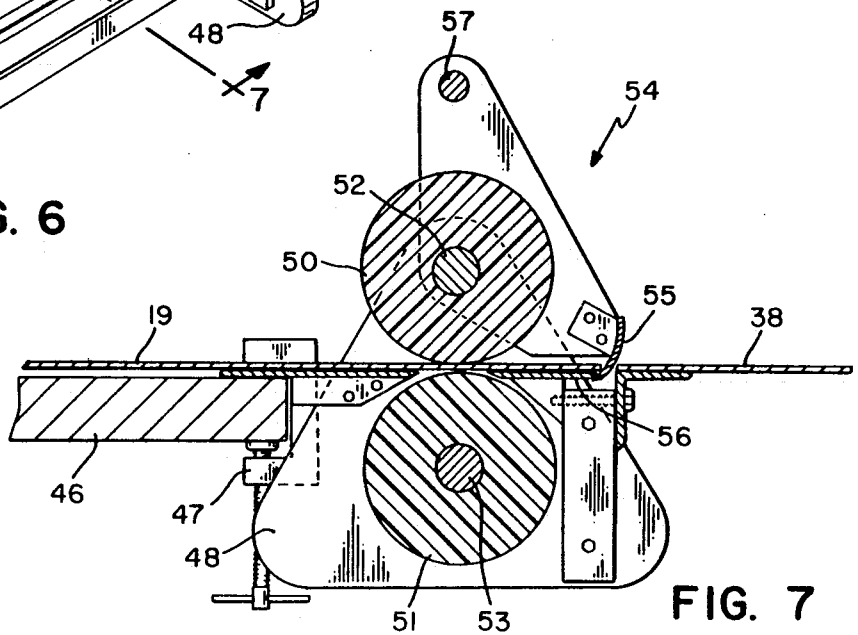
FIG. 7 is a cross sectional view of the mechanism taken along line 7—7 of FIG. 6.

FIGS. 6 and 7 show another embodiment of the advancing and cutting mechanism of this invention. There shown is a bench or working table 46 to which a clamping structure 47 is attached. Fixed to the opposing clamping structures 47 are opposed and parallel frame structure members 48 of the advancing and cutting mechanism. An advancing structure 49 is provided and which is comprised of a drive roller 50, an idler roller 51 and shafts 52 and 53, respectively. The shafts 52 and 53 are mounted for rotation between the frame structure members 48. A cutting structure 54 is also provided and which is comprised of an upper cutting member 55 and a lower cutting member 56. The curved upper cutting member 55 is shown attached to opposing support members which are mounted for rotation to the drive shaft 52. The lower cutting member 56 is shown mounted between the spaced frame members 48. A handle member 57 is provided between the opposing support members and which can be utilized to manually activate the cutting structure 54. Optionally, as shown in FIG. 6, a pneumatic, electric or hydraulic activation structure 58 can be utilized to automatically activate the cutting structure 54. With respect to the latter, a piston/connection structure 59 is shown to be in communication with the cutting structure 54. A motor 60 is further shown in communication with the drive shaft 52 to power the advancing structure 49. This mechanism 49 is shown to advance the film or tape supply stream 19 and to yield cut portions of film or tape 38, as shown in FIG. 7. In summary, this advancing and cutting embodiment is a portable device which can easily be transported to a film supply source or the like and mounted to an existing structure for use. The embodiment can be utilized in a manual or automatic manner.

Figure 8:
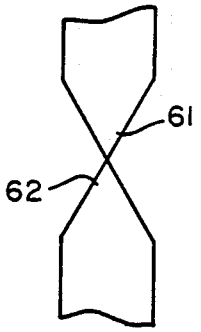
FIGS. 8–10 are exploded views showing alternate upper and lower cutting portions of the mechanism embodiments.
Figure 9:
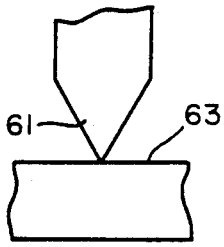
Figure 10:
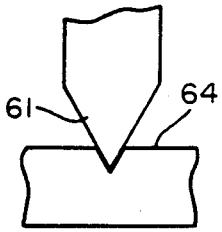

FIGS. 8, 9 and 10 show various upper and lower cutting edge configurations that can be used with the embodiments of this invention. FIG. 8 shows a pointed upper cutting edge 61 utilized in cooperation with a pointed bottom cutting edge 62. FIG. 9 shows the utilization of a pointed upper cutting edge 61 used in conjunction with a flat and/or resilient bottom member 63. FIG. 10 shows a pointed upper cutting edge 61 utilized with a grooved or slotted bottom member 64.

Figure 11:
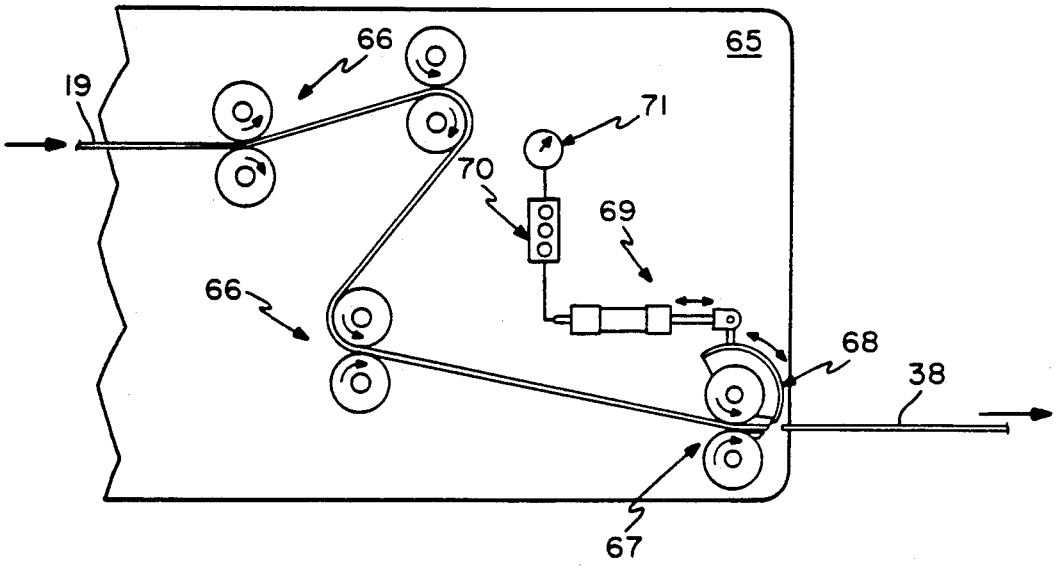
FIG. 11 is a lateral plan view of another embodiment of the mechanism of this invention.

As shown in FIG. 11, a film or tape advancing and cutting mechanism is there shown having a film or tape supply stream 19. The mechanism is comprised of a frame 65 on which a plurality of roller structures 66 are mounted. The film or tape supply stream 19 is fed through each roller structure 14, each comprising a driven roller and an idler roller which are supported by their respective shafts which are mounted to the frame 65.

Further shown mounted to the frame 65 is an advancing structure 67 and a pivotable cutting structure 68. The advancing and cutting structures 67 and 68 are as discussed above with respect to the other embodiments of this invention.

The pivotable cutting structure 68 is activated by an activation mechanism 69 which is comprised of a push button and control 70 and/or a timer device 71. This activation mechanism 69 can be either manual or timed to cut the film or tape supply stream 19 into cut film or tape segments 38. The timed movement of the cutting structure 68 can be either pneumatic, hydraulic, electric or hand operated, as discussed above.

Referring to FIGS. 1–4, apertures can be provided in the frame structure 12 for bench mounting of the embodiments. Drive rollers 21 can further have a ribbed surface configuration for gripping the film or tape supply stream 19. Alternatively, the drive roller 21 can be constructed of metal and have a serrated surface with ridges disposed perpendicularly to the path of tape travel. Also, the idler roller 22 can be constructed of a non-stick teflon or silicone surface to permit easy passage of the adhesive bottom surface of the tape supply stream 19. In summary, the film advancing and cutting mechanism embodiments of this invention are provided to advance and cut strips of film or tape from a film or tape source, such as a roll 17 as shown in FIGS. 1–5, sheets as shown in FIGS. 6 and 7 or a constant feed as shown in FIG. 11. The various embodiments of this invention provide structures that result in clean film cuts at low operating pressures.

As many changes are possible to the embodiments of this invention, utilizing the teachings of the invention, the description above, and the accompanying drawings, should be viewed in the illustrative, and not in the limited sense.

That which is claimed is:

1. A dispensing and cutting mechanism for film-like substrates comprising:

(a) a frame structure, (b) means for holding a supply of film for rotation with respect to said frame structure, (c) an advancing roller structure for moving film from said film supply, said advancing roller structure being further comprised of an idler roller and a drive roller, said idler and drive rollers further having a drive shaft and an idler shaft respectively, said drive and idler shafts further being aligned and mounted for rotation in said frame structure, (d) means to drive said advancing roller structure, and (e) a cutting structure mounted forward said advancing roller structure to sever a length of film substrate, said cutting structure having a rotatable upper cutting structure and a cooperating bottom cutting structure, said cooperating bottom cutting structure having a fixed bottom cutting edge mounted to said frame structure forward and generally in line with said idler roller and wherein said rotatable upper cutting structure is mounted to said drive shaft, and wherein said upper cutting structure moves through a radial path and has an upper cutting edge having a curved configuration defined by said radial path, whereby said drive roller and said upper cutting structure have said drive shaft as a common center.

2. The dispensing and cutting mechanism of claim 1, wherein said cooperating bottom cutting structure has a bottom cutting edge and wherein said bottom cutting edge is disposed at an angle of approximately 15 degrees downward from a horizontal line with respect to the tangential communication of said idler roller and said drive roller.

3. The dispensing and cutting mechanism of claim 2, wherein said rotatable upper cutting structure has a horizontally extending lever for gripping engagement by a user, and wherein said drive means is comprised of a drive wheel fixed to said drive shaft.

4. The dispensing and cutting mechanism of claim 1, wherein said lower cutting structure has a lower cutting edge, and wherein said upper cutting edge is at an angle with respect to said lower cutting edge whereby said cooperation of said upper and lower cutting edges results in a shear cutting action.

5. The dispensing and cutting mechanism of claim 1, wherein said means to drive said advancing roller structure is comprised of a motor and wherein said upper cutting structure further has a powered and activatable structure mounted in communication therewith.

6. The dispensing and cutting mechanism of claim 1, wherein said upper cutting structure has biasing means attached thereto and to said frame structure for returning said upper cutting structure after use, and wherein said upper cutting structure is constructed and arranged to have a replaceable cutting edge.

7. The dispensing and cutting mechanism of claim 1, wherein said frame structure further has means for mounting said mechanism to a generally horizontally disposed base member.

8. The dispensing and cutting mechanism of claim 1, wherein said frame structure further has a shaft extending downwardly therefrom and further having an adjustable clamping structure for receiving said downwardly extending shaft.

9. The dispensing and cutting mechanism of claim 1, wherein a housing structure is attached adjacent said frame structure and being positioned to surround said film supply holding means, wherein said driving means for said advancing roller structure is comprised of a drive wheel having a knurled circumferential surface and wherein said drive wheel has an outwardly extending handle member.

10. The dispensing and cutting mechanism of claim 1, wherein said frame structure is comprised of spaced and parallel plate members, said rollers being mounted for rotation in aligned configuration between said plate members, wherein said cutting structure is further comprised of spaced and parallel support members mounted for rotation to said plate members, said upper cutting structure further being fixed between said support members, and wherein said bottom cutting structure is mounted between said parallel plate members and in alignment with said rotatable upper cutting structure.

11. A hand operable, tape dispensing device comprising:

(a) a frame structure, (b) means for holding a roll of tape, said holding means being mounted to said frame structure and being constructed and arranged to permit rotation of the tape roll, (c) an idler roller mounted for rotation to said frame structure, (d) a drive roller mounted for rotation to said frame structure and being in touching engagement with said idler roller, said drive roller further having a drive shaft extending through said frame structure, (e) a drive wheel mounted on said drive shaft end on the opposite side of said frame structure, (f) a fixed bottom cutting structure mounted to said frame structure and generally in line with said idler roller, and (g) a pivotable upper cutting structure mounted to said drive shaft and having a curved cutting edge of a predetermined configuration, said upper cutting structure being constructed and arranged to cooperate with said fixed bottom cutting structure to sever a length of tape advanced between said idler and drive rollers.

12. The tape dispensing device of claim 11, wherein said pivotable upper cutting structure has biasing means attached thereto and to said frame structure..

13. The tape dispensing device of claim 11, wherein said frame structure further has a housing structure attached thereto and adjacent said tape roll holding means.

14. The tape dispensing device of claim 11, wherein said pivotable upper cutting structure has a grooved upper surface for engagement by the thumb of a user to activate said upper cutting structure.

15. The tape dispensing device of claim 11, wherein said fixed bottom cutting structure has a curved bottom cutting edge of the same said predetermined curved configuration as said upper curved cutting edge.

16. A dispensing and cutting mechanism for a film substrate source comprising:

a. a frame structure, b. means to advance film substrate from the film substrate source, said advancing means being mounted to said frame structure, said advancing means having a shaft, and c. a cutting structure mounted to said frame structure and being positioned downstream said advancing means, said cutting structure further comprising a rotatable upper cutting structure and a fixed lower cutting structure in alignment with said upper cutting structure, said upper cutting structure further having a curved cutting blade having a predetermined radius defined by the radial movement of said rotatable upper cutting structure, said upper cutting structure being mounted for rotation on said advancing means shaft, whereby the radial movement of said upper cutting structure towards said aligned lower cutting structure causes scissor-like cutting of a length of the film substrate.

* * * * *